US011143400B2

(12) United States Patent
Zhang et al.

(10) Patent No.: US 11,143,400 B2
(45) Date of Patent: Oct. 12, 2021

(54) STABLE AND ENVIRONMENTALLY FRIENDLY COMBUSTION METHOD FOR BIOMASS GASIFICATION, COMBUSTIBLE GAS, AND ENVIRONMENTALLY FRIENDLY COMBUSTION CHAMBER

(71) Applicant: NANJING FORESTRY UNIVERSITY, Nanjing (CN)

(72) Inventors: Yimeng Zhang, Nanjing (CN); Jianbin Zhou, Nanjing (CN); Huanhuan Ma, Nanjing (CN)

(73) Assignee: NANJING FORESTRY UNIVERSITY, Nanjing (CN)

( * ) Notice: Subject to any disclaimer, the term of this patent is extended or adjusted under 35 U.S.C. 154(b) by 179 days.

(21) Appl. No.: 16/483,963

(22) PCT Filed: Aug. 28, 2018

(86) PCT No.: PCT/CN2018/102794
§ 371 (c)(1),
(2) Date: Oct. 6, 2019

(87) PCT Pub. No.: WO2019/011346
PCT Pub. Date: Jan. 17, 2019

(65) Prior Publication Data

US 2020/0056784 A1 Feb. 20, 2020

(30) Foreign Application Priority Data

Jul. 14, 2017 (CN) ..... 201710576972.9

(51) Int. Cl.
*F23G 5/027* (2006.01)
*F23G 5/38* (2006.01)
(Continued)

(52) U.S. Cl.
CPC ..... *F23G 5/0273* (2013.01); *F23G 5/16* (2013.01); *F23G 5/38* (2013.01); *F23G 5/46* (2013.01);
(Continued)

(58) Field of Classification Search
CPC . F23G 5/0273; F23G 5/16; F23G 5/38; F23G 5/46; F23G 7/10; F23G 2200/00; F23G 2204/00; F23G 2207/30
See application file for complete search history.

(56) References Cited

U.S. PATENT DOCUMENTS 3,048,130 A * 8/1962 Morgan ..... F23G 5/16 110/211
3,509,834 A * 5/1970 Rosenberg et al. ..... F23G 5/16 110/191
(Continued)

FOREIGN PATENT DOCUMENTS

CN 2714965 8/2005
CN 202361774 8/2012
(Continued)

*Primary Examiner* — David J Laux
(74) *Attorney, Agent, or Firm* — Law Offices Of Steven W. Weinrieb

(57) ABSTRACT

An environmentally friendly combustion chamber for stable combustion of biomass gasification combustible gas. The combustion chamber is divided into a first stage cavity body (45) and a second stage cavity body (48) by a honeycomb-shaped heat storage body (46). A combustion pipe (41) is connected to a biomass gas inlet and a primary air distribution pipe (54), the combustion pipe (41) is connected to the first stage cavity body (45), and an ignition gun (42) and a thermocouple T1 are arranged on the first stage cavity body (45). A secondary air distribution pipe (47), opposite the honeycomb-shaped heat storage body (46), and a thermocouple T2 are arranged within the second stage cavity body (48), and the second stage cavity body (48) is connected to
(Continued)

an outlet high temperature flue gas pipe (51). The primary air distribution pipe (54), a primary air volume adjustment valve (52), the secondary air distribution pipe (47) and a secondary air volume adjustment valve (53) are connected together to an air supply fan (49), and a controller (50) is connected to the thermocouple T1, the thermocouple T2, the primary air volume adjustment valve (52), the secondary air volume adjustment valve (53) and the air supply fan (49). The combustion chamber solves the problems of unstable combustion flames in traditional combustors, and high nitrogen oxide amounts in tail flue gas.

3 Claims, 4 Drawing Sheets

(51) Int. Cl.
*F23G 5/46* (2006.01)
*F23G 7/10* (2006.01)
*F23G 5/16* (2006.01)

(52) U.S. Cl.
CPC ..... *F23G 7/10* (2013.01); *F23G 2200/00* (2013.01); *F23G 2204/00* (2013.01); *F23G 2207/30* (2013.01)

(56) References Cited

U.S. PATENT DOCUMENTS

| | | | | | |
|---|---|---|---|---|---|
| 3,543,701 | A * | 12/1970 | Doner | F23G 5/16 | 110/211 |
| 3,806,322 | A * | 4/1974 | Tabak | F23G 7/066 | 422/170 |
| 4,373,452 | A * | 2/1983 | Van Dewoestine | F23B 5/00 | 110/203 |
| 4,862,869 | A * | 9/1989 | Hazard | F23B 5/04 | 126/77 |
| RE33,077 | E * | 10/1989 | Van Dewoestine | F23B 5/00 | 110/203 |
| 4,984,560 | A * | 1/1991 | Hazard | F23B 5/04 | 126/169 |
| 5,178,076 | A * | 1/1993 | Hand | F23G 5/004 | 110/210 |
| 2013/0052094 | A1* | 2/2013 | Pley | F23B 90/08 | 422/170 |
| 2018/0119959 | A1* | 5/2018 | Purinton | F23B 90/08 | |

FOREIGN PATENT DOCUMENTS

| | | |
|---|---|---|
| CN | 203744238 | 7/2014 |
| CN | 204275781 | 4/2015 |
| CN | 205373010 | 7/2016 |
| CN | 205664376 | 10/2016 |
| CN | 107366901 | 11/2017 |
| EP | 0483878 | 10/1991 |

* cited by examiner

STABLE AND ENVIRONMENTALLY FRIENDLY COMBUSTION METHOD FOR BIOMASS GASIFICATION, COMBUSTIBLE GAS, AND ENVIRONMENTALLY FRIENDLY COMBUSTION CHAMBER

FIELD OF THE INVENTION

The invention relates to a stable and environmentally friendly combustion chamber for biomass gasification combustible gas and a stable and environmentally friendly combustion method for biomass gasification combustible gas, belonging to the field of biomass energy and solid waste treatment.

BACKGROUND OF THE INVENTION

In the current biomass gasification technology, the combustible gas produced by gasification has the following characteristics:

1) the gasification of combustible gas due to the diversity of biomass materials (materials are different in nature, shape is different, water content is not the same, etc.), the calorific value of combustible gas is unstable, and air is used as a gasifying agent, for the generation of combustible gas, the high can reach about 1300 kcal, and the low can reach about 850 kcal; and 2) the gasification of combustible gas contains more kinds of impurities, including tar, water, and dust.

At present, the utilization of biomass gasification combustible gas is mainly in the following ways:

1) through deep gas combustion purification technology, the purified combustible gas can be used to provide power to the internal combustion engine and provide combustion to the boiler, but a large amount of extract liquid and tar are produced during the purification process, but if it is not used properly, it will pollute the environment; and 2) the combustible gas is not purified, and the hot gas is directly supplied to the boiler for combustion.

In China, when small and medium-sized boilers are prohibited from burning coal, a large number of small and medium-sized boilers must be rebuilt, and biomass gasification carbon and gas cogeneration technologies are the first choice in terms of economy and environmental protection.

The traditional combustible gas combustion technology uses a gas burner, while the traditional burner is developed on the basis of natural gas, the fixed calorific value of the gas and the fixed air volume cannot be adapted to the instability of the biomass combustible gas calorific value, if such a burner is used, the following problems may occur:

1) the air distribution system does not adapt to the change of the calorific value, if the fire is often broken and the combustion is unstable, it is prone to safety problems:

2) if the automatic igniter is contaminated by tar or water, it may cause false ignition or misfire.

Therefore, there is an urgent need to develop an environmentally friendly combustion chamber that can adapt to the stable combustion of biomass hot gas.

SUMMARY OF THE INVENTION

The present invention provides a stable and environmentally friendly combustion chamber for biomass gasification combustible gas, the purpose of which is to adapt to the characteristics of biomass gasification combustible gas, and solves the problem of biomass combustible gas calorific value fluctuation due to the instability of the combustion flame of the traditional burner and the high nitrogen oxide amounts in the tail flue gas after combustion of the combustible gas.

The present invention provides an environmentally friendly combustion chamber for stable combustion of biomass gasification combustible gas. The combustion chamber is divided into a first stage cavity body 45 and a second stage cavity body 48 by a honeycomb-shaped heat storage body 46. A combustion pipe 41 is connected to a biomass gas inlet and a primary air distribution pipe 54, the combustion pipe 41 is connected to the first stage cavity body 45, and an ignition gun 42 and a thermocouple T1 are arranged on the first stage cavity body 45. A secondary air distribution pipe 47, opposite the honeycomb-shaped heat storage body 46, and a thermocouple T2 are arranged within the second stage cavity body 48, and the second stage cavity body 48 is connected to an outlet high temperature flue gas pipe 51. The primary air distribution pipe 54, a primary air volume adjustment valve 52, the secondary air distribution pipe 47 and a secondary air volume adjustment valve 53 are connected together to an air supply fan 49, and a controller 50 is connected to the thermocouple T1, the thermocouple T2, the primary air volume adjustment valve 52, the secondary air volume adjustment valve 53 and the air supply fan 49.

The combustion chamber adopts a honeycomb-shaped heat storage body, and the heat storage body dissipates heat slowly, ensuring that the temperature thereof is always higher than the combustible gas burning point, that is, ensuring stable combustion of the low calorific value combustible gas, and the combustion chamber adopts a two-stage combustion chamber and a two-stage automatic air distribution structure to control the combustion temperature and create a reducing atmosphere for the combustion of combustible gas, so that achieve the purpose of controlling the nitrogen oxide amounts of the exhaust gas.

Therefore, the combustion chamber is suitable for stable and environmentally friendly combustion chamber for biomass gasification combustible gas, and solves the problem of biomass combustible gas calorific value fluctuation due to the instability of the combustion flame of the traditional burner and the high nitrogen oxide amounts in the tail flue gas after combustion of the combustible gas.

The distance between the honeycomb-shaped heat storage body 46 and the end of the inlet combustion pipe 41 is 1.1-1.3 times of the length of the combustion flame, the heat storage body is coaxial with the combustion pipe, the middle portion of the heat storage body has a non-opening area that is as large as the cross-sectional area of the combustion pipe, the peripheral portion of the heat storage body is opened a through hole, the flow area of the through hole is 40-50% of the cross-sectional area of the peripheral portion of the heat storage body, the material of the heat storage body is zirconium corundum brick or magnesia chrome brick, etc. The heat storage body maintains a high temperature state, and the low calorific value combustible gas is directly oxidized and exothermic in aerobic and high temperature conditions, thereby ensuring stable operation of the system when the calorific value of the biomass combustible gas fluctuates greatly.

The primary air volume entering the combustion pipe through the primary air distribution pipe 54 is about 90% of the required air volume of the combustible gas; the secondary air volume entering the second stage cavity body through the secondary air distribution pipe is, 10% of the required air volume of the combustible gas; the temperature of the first stage cavity body is below 1000° C.

The primary air volume is about 90% of the required air volume of the combustible gas, and the secondary air volume is about 10% of the required air volume of the combustible gas, so that the combustion is performed under a reducing atmosphere; and second, the controller obtains the overheat temperature signal from the thermocouple T1, adjusting the primary air volume adjustment valve 52 and the secondary air volume adjustment valve 53 to reduce the primary air volume, and simultaneously increase the secondary air volume, and control the temperature of the primary cavity body to be below 1000° C., thereby reach the purpose of reducing the generation of thermal and fuel-type nitrogen oxides.

The present invention also provides a stable and environmentally friendly combustion method for biomass gasification combustible gas for reducing the generation of nitrogen oxides.

The stable and environmentally friendly combustion method of the biomass gasification combustible gas according to the present invention adopts the above-mentioned environmentally friendly combustion chamber, and a controller 50 by controlling the opening degree of the primary air volume adjustment valve 52 and the secondary air volume adjustment valve 53, the air volume entering the combustion pipe through the primary air distribution pipe 54 is about 90% of the required air volume of the combustible gas, the secondary air volume entering the second stage cavity body through the secondary air distribution pipe 47 is 10% of the required air volume of the combustible gas.

In the above-mentioned stable and environmentally friendly combustion method for biomass gasification combustible gas, the controller monitors the temperature signal of the first stage cavity body from the thermocouple T1 in real time; if the temperature in the first stage cavity body exceeds 1000° C., the controller adjusts the primary air volume adjustment valve 52 and the secondary air volume adjustment valve 53 to reduce the primary air volume and simultaneously increase the secondary air volume, so that the temperature of the first stage cavity body is below 1000° C.

The function of the controller 50 is as follows:

1) Controlling the primary air volume to be about 90% of the required air volume of the combustible gas, and the secondary air volume is about 10% of the required air volume of the combustible gas, so that the combustion is performed under a reducing atmosphere, and reducing the generation of the nitrogen oxides; and 2) Controlling the temperature of the first stage cavity body is below 1000° C., the controller obtains the overheat temperature signal from the thermocouple T1, and adjusts the primary air volume adjustment valve 52 and the secondary air volume adjustment valve 53 to reduce the primary air volume, and simultaneously increase the secondary air volume, so that reducing the generation of thermal nitrogen oxides. Thereby achieve the purpose of reducing the generation of nitrogen oxides and being more environmentally friendly.

ADVANTAGES OF THE INVENTION

1) The burner can adapt to the wide fluctuation of the calorific value of the combustible gas. The combustion chamber uses honeycomb-shaped heat storage body, and the heat storage body dissipates heat slowly, ensuring that the temperature thereof is always higher than the combustible gas burning point, that is, ensuring the stable combustion of the low calorific value.

2) The combustion chamber adopts a two-stage combustion chamber and a two-stage automatic air distribution structure to control the combustion temperature and create a reducing atmosphere for combustible gas, so that achieve the purpose of controlling the nitrogen oxide amounts of the exhaust gas.

Therefore, the combustion chamber is suitable for stable and environmentally friendly combustion chamber for biomass gasification combustible gas.

The reference numbers in drawings are as follows:

41 is a combustion pipe,
42 is an igniter,
43 is a fire door,
45 is a first stage cavity body,
46 is a heat storage body,
461 is an intermediate portion of the heat storage body,
462 is a peripheral portion of the heat storage body (open area), 463 is a through hole,
47 is a secondary air distribution pipe,
471 is a secondary air distribution pipe air outlet,
48 is a second stage cavity body,
49 is a blower,
50 is a controller,
51 is an outlet high temperature flue gas pipe,
52 is a primary air volume adjustment valve,
53 is a secondary air volume adjustment valve, and
54 is a primary air distribution pipe.

DETAILED DESCRIPTION

Figure 1:
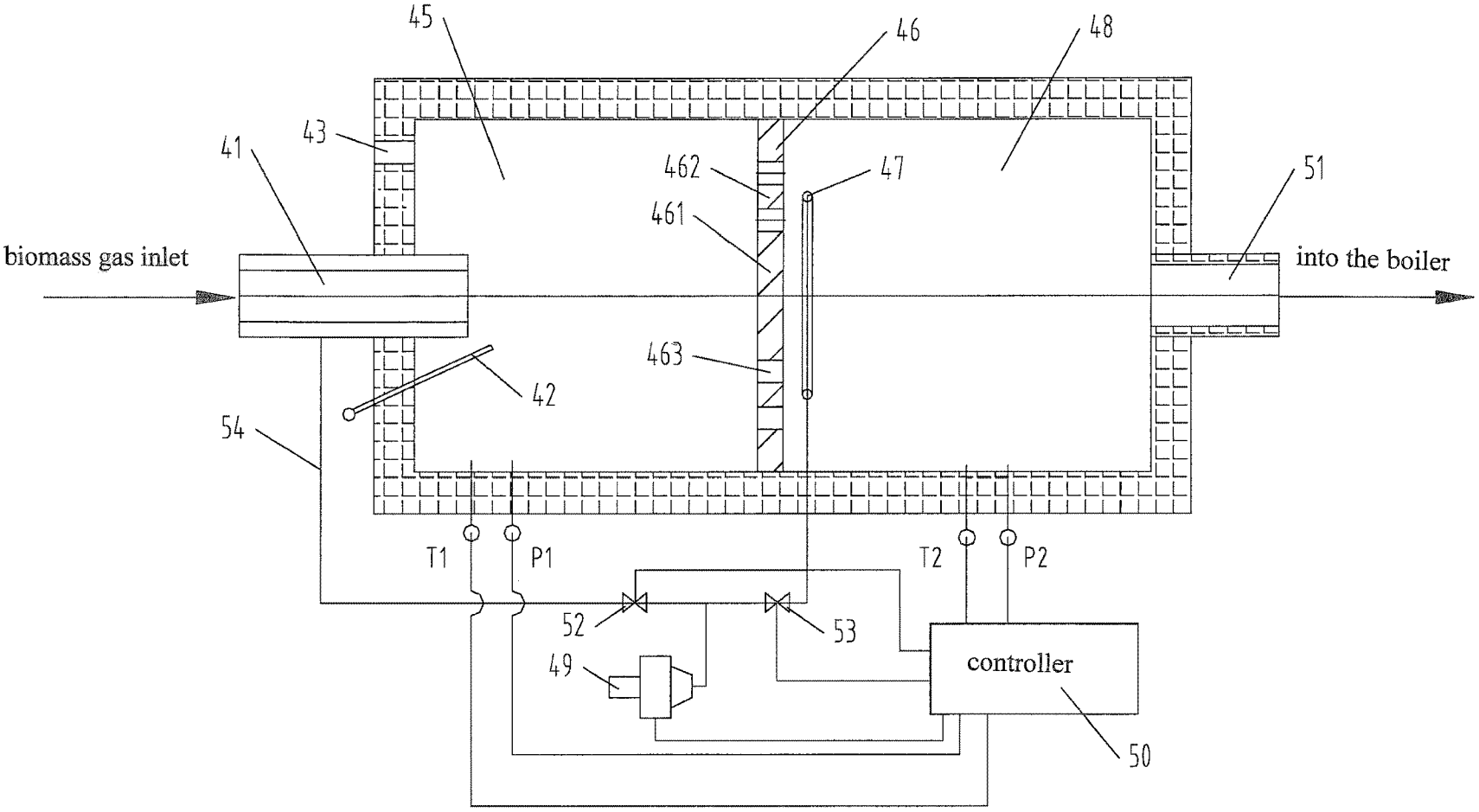
FIG. 1 is a schematic structural view of a stable and environmentally friendly combustion chamber for biomass gasification combustible gas.

Referring to FIG. 1, a stable and environmentally friendly combustion chamber for biomass gasification combustible gas comprising: a combustion pipe 41 is connected to a biomass gas inlet and a primary air distribution pipe 54; the combustion pipe 41 is connected to a primary chamber body 45. The first stage cavity body 45 is provided with an ignition gun 42, a fire door 43, and a thermocouple T1. The rear end of the first stage cavity body is connected to the honeycomb-shaped heat storage body 46, and the rear side of the honeycomb-shaped heat storage body 46 is connected to the second stage cavity body 48, the second stage cavity body 48 (the rear side of the honeycomb-shaped heat storage body 46) is provided with a secondary air distribution pipe 47, a thermocouple T2, the second stage cavity body 48 is connected to the outlet high temperature flue gas pipe 51, the primary air distribution pipe 54 is connected to the air blower 49 through the primary air volume adjustment valve 52 and the secondary air distribution pipe 47 is connected to the air blower 49 through the secondary air volume adjustment valve 53, and the controller 50 is connected to the thermocouple T1, the thermocouple T2, the primary air volume adjustment valve 52, the secondary air volume adjustment valve 53, and the air supply fan 49, thereby formed a combustion chamber.

The function of the controller 50 is as follows:

1) Controlling the primary air volume to be about 90% of the required air volume of the combustible gas, the secondary air volume is about 10% of the required air volume of the combustible gas; and 2) The temperature of the first stage cavity body is controlled at 1000° C., the controller obtains the overheat temperature signal from the thermocouple T1, adjusting the primary air volume adjustment valve 52 and the secondary air volume adjustment valve 53 to reduce the primary air volume and simultaneously increase the secondary air volume.

Figure 2:
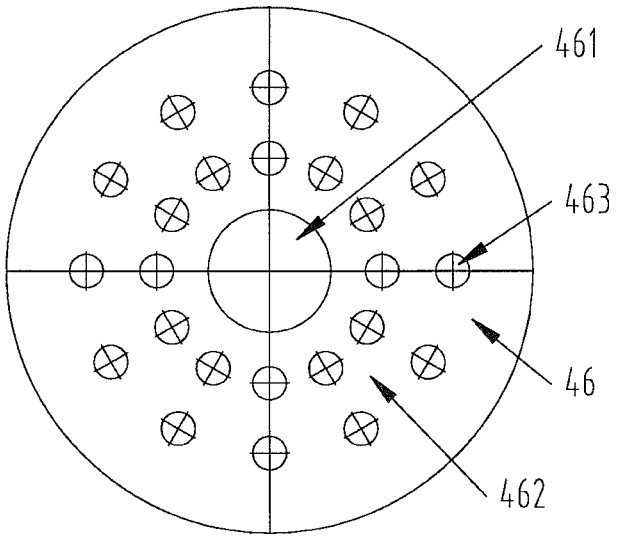
FIG. 2 is a schematic view of a heat storage body.
Figure 3:
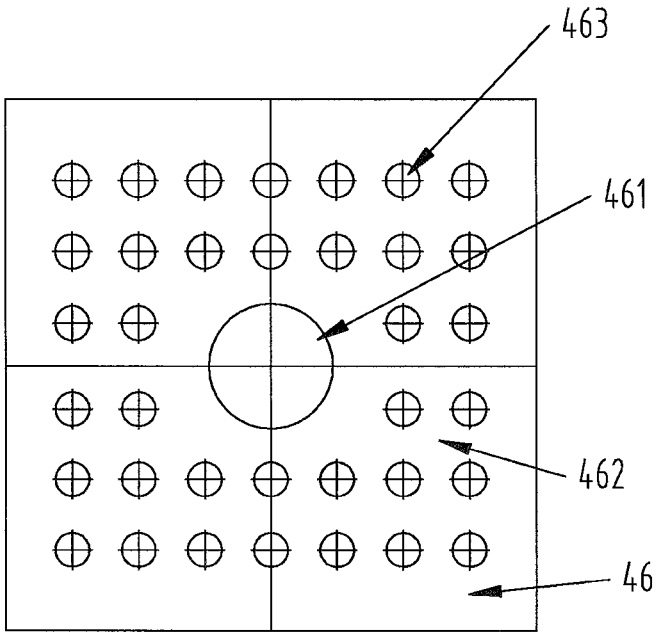
FIG. 3 is a schematic view of another heat storage body.

Referring to the heat storage bodies shown in FIGS. 2 and 3, the shape of the heat storage body 46 may vary depending on the shape of the cavity body, and may be a square shape or a circular shape. The distance between the front end surface of the heat storage body 46 and the end portion of the inlet combustion pipe 41 is 1.1-1.3 times of the length of the combustion flame. The flow area of the through hole of the heat storage body is 40-50% of the cross-sectional area of the honeycomb-shaped heat storage body, and the intermediate portion 461 of the heat storage body is not opened, and the cross-sectional area of the non-opening area is substantially the same as the cross-sectional area of the combustion tube, and the peripheral portion 462 of the heat storage body is an open area, and the area is provided with a through hole 463, and the sum of the flow areas (cross-sectional areas) of the through holes is 40-50% of the cross-sectional area of the open area of the peripheral portion of the heat storage body, the heat storage body material is zirconium corundum brick or magnesia chrome brick which has a heat storage capacity and a high temperature resistance.

Figure 4:
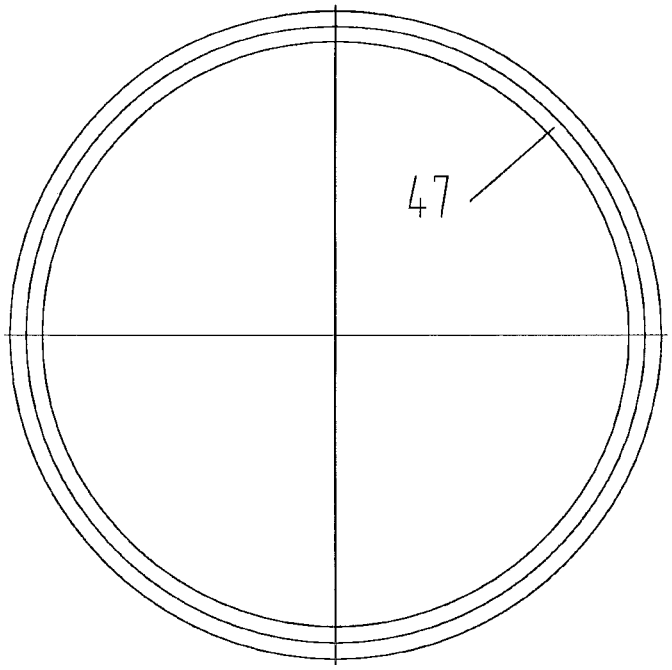
FIG. 4 is a schematic view of a secondary air distribution pipe.
Figure 5:
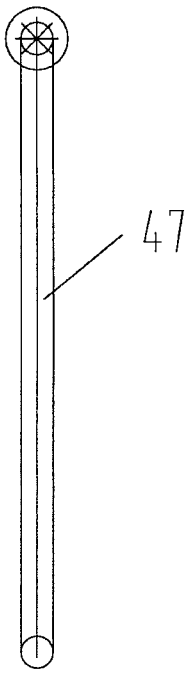
FIG. 5 is a left side view of FIG. 4.
Figure 6:
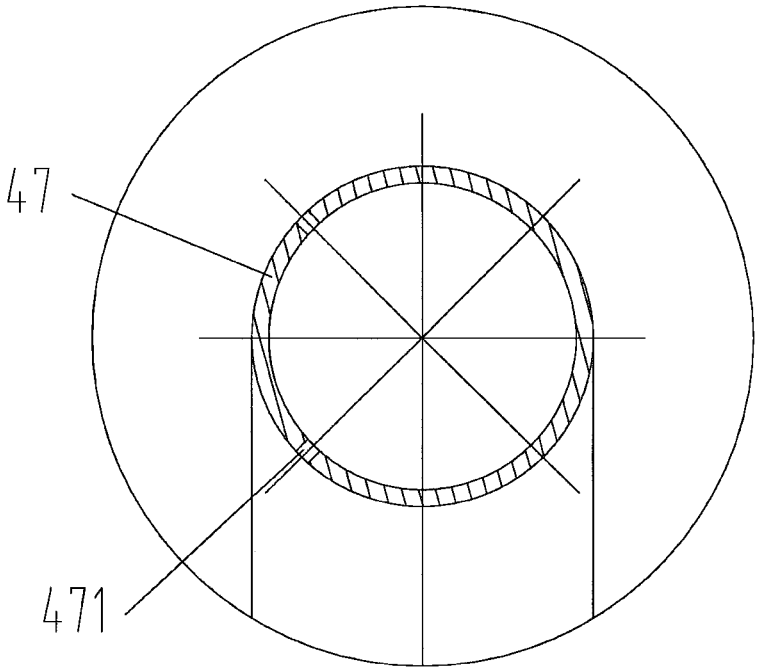
FIG. 6 is a partial enlarged view of FIG. 5.

Referring to the secondary air distribution pipe shown in FIGS. 4-6, the secondary air distribution pipe 47 is located at a distance of 100-200 cm from the rear end surface of the heat storage body 46, and the air distribution pipe is also vary according to the shape of the cavity body, and may be a square shape or may be designed in a circular shape, and the secondary air distribution pipe 47 has a secondary air pipe outlet 471 uniformly open toward the side of the heat accumulator 46.

WORKING PROCESS EXAMPLE

The biomass combustible gas produced by the gasification of straw or wood chips, assuming an initial calorific value of 1000 kcal, which containing tar, water, and a small amount of dust, which enters the combustion chamber through the combustion pipe of the combustion chamber.

During the initial air supply, the primary air volume sent into the first stage cavity body is 90% of the total air volume, and the secondary air volume sent into the second stage cavity body is 10% of the total air volume.

It forms an oxygen-limited combustion environment in the first stage cavity body, while the fuel-type nitrogen oxides is produced under an oxidizing atmosphere, and the amount of the combustion-type nitrogen oxide amounts produced by the first stage cavity body is greatly reduced.

There is also 10% of the combustible gas that is not burned; the oxygen is supplied through the second stage cavity body for combustion. The temperature of the first stage cavity body is controlled to be below 1000° C. by controlling the air supply volume of the first stage cavity body. If the temperature is exceeded, the controller will automatically reduce the amount of the air volume, thus reduces the generation of thermal nitrogen oxides.

The heat storage body keeps the temperature under the burning of the combustible gas combustion flame. When the combustible gas has large fluctuations, for example, the calorific value of the combustible gas suddenly drops to 650 Kacl, at this time, the flame may be instantaneously broken due to the air distribution, when the combustible gas is directly sprayed onto the high-temperature heat storage body and re-ignites immediately (even if it can't be burned immediately, the low-calorific value combustible gas will be oxidized immediately). At the same time, the controller automatically adjusts the supply air volume to ensure oxygen supply, thus ensuring that the combustible gas does not fluctuate due to the calorific value. The non-combustible gas will not accumulate in the subsequent boiler to cause a safety accident, and also ensuring the stable operation of the combustion chamber.

Therefore, the combustion chamber of the present invention can realize the stable combustion of the biomass gasification hot gas with the fluctuation of the calorific value, and reduce the nitrogen oxide amounts, thereby ensuring the environmental protection of the combustion.

What is claimed is:

1. A stable and environmentally friendly combustion chamber for biomass gasification combustible gas, characterized in that:

the combustion chamber is divided into a first stage cavity body (45) and a second stage cavity body (48) by a honeycomb-shaped heat storage body (46);

a combustion pipe (41) is connected to a biomass gas inlet and a primary air distribution pipe (54); the combustion pipe (41) is connected to the first stage cavity body (45), and an ignition gun (42) and a thermocouple T1 are arranged on the first stage cavity body (45), a secondary air distribution pipe (47), opposite to the honeycomb-shaped heat storage body (46), and a thermocouple T2 are arranged within the second stage cavity body (48) and the second stage cavity body (48) is connected to the outlet high temperature flue gas pipe (51), the primary air distribution pipe (54), a primary air volume adjustment valve (52), the secondary air distribution pipe (47) and a secondary air volume adjustment valve (53) are connected to a air supply fan (49),and a controller (50) is connected to the thermocouple T1, the thermocouple T2, the primary air volume adjustment valve (52), the secondary air volume adjustment valve (53), and the air supply fan (49).

2. A stable and environmentally friendly combustion chamber for biomass gasification combustible gas according to claim 1, characterized in that:

the distance between the honeycomb-shaped heat storage body (46) and the end of the inlet combustion pipe (41) is 1.1-1.3 times of the length of the combustion flame;

the heat storage body is coaxial with the combustion pipe;

the middle portion of the heat storage body has a non-opening area that is as large as the cross-sectional area of the combustion pipe;

the peripheral portion of the heat storage body is opened a through hole;

the flow area of the through hole is 40-50% of the cross-sectional area of the peripheral portion of the heat storage body; and the material of the heat storage body is zirconium corundum brick or magnesia chrome brick.

3. A stable and environmentally friendly combustion chamber for biomass gasification combustible gas according to claim 1, characterized in that:

the primary air volume entering the combustion pipe through the primary air distribution pipe (54) is about 90% of the required air volume of the combustible gas;

the secondary air volume entering the second stage cavity body through the secondary air distribution pipe is 10% of the required air volume of the combustible gas; and the temperature of the first stage cavity body is below 1000° C.

* * * * *